US005682711A

United States Patent [19]

Warczak

[11] Patent Number: 5,682,711

[45] Date of Patent: Nov. 4, 1997

[54] GAME FIELD

[76] Inventor: Russell C. Warczak, 131 Foster Ave., Bensenville, Ill. 60106

[21] Appl. No.: 638,018

[22] Filed: Apr. 25, 1996

[51] Int. Cl.[6] ..... E04H 3/10

[52] U.S. Cl. ..... 52/6; 52/7

[58] Field of Search ..... 52/6, 7

[56] References Cited

U.S. PATENT DOCUMENTS 5,103,600 4/1992 Geiger et al. ..... 52/7 X

FOREIGN PATENT DOCUMENTS 758498 1/1934 France ..... 472/92

1704261 10/1994 France ..... 52/6

4327868 11/1992 Japan ..... 472/92

8804944 7/1988 WIPO ..... 472/92

*Primary Examiner*—Carl D. Friedman

*Assistant Examiner*—W. Glenn Edwards

*Attorney, Agent, or Firm*—Paul H. Gallagher

[57] ABSTRACT

A fixed domed structure, and a pair of movable units each having an arena for playing a game thereon. The fixed structure includes fixed amphitheater seats around a center void where a movable unit is located when in active position. One of the movable units also includes bleacher seats carried thereby, surrounding a smaller arena. When this latter movable unit is in active position, the bleacher seats form a continuation of the fixed amphitheater seats.

14 Claims, 5 Drawing Sheets

GAME FIELD

SUMMARY OF THE INVENTION

The invention resides in the general field of public performances put on before seated spectators, usually represented by sports games, and among those, very often football games.

The invention involves a fixed indoor or domed stadium structure enclosing and covering the arena or playing field.

A special feature of the invention is that instead of the dome being removable, or openable, the arena or playing field is incorporated in a unit that is movable and can be withdrawn from the structure to the exterior.

Another important feature is that a plurality of such movable units may be provided, each having an arena or playing field, and can be selectively placed in active or playing position in the domed structure, and removed therefrom, to enable the different ones to be individually put in position therein.

An additional feature is that at least one of the movable units has an arena and surrounding bleacher seats carried with the arena in a single unit; this movable unit is positionable in the domed stadium structure, with the bleacher seats forming a continuation of the fixed amphitheater seats that are provided in the stadium structure.

A further feature of the invention is that in the arrangement of the stadium structure and surrounding area, a base is provided for not only holding the movable units when they are placed thereon, but also providing parking space, including indoor parking.

Another feature is to provide unusual and effective means for moving the movable units.

Still another feature is the provision of a hover feature, wherein the complete movable unit is supported by only a cushion of air, and can be easily moved, on that cushion, between indoor and outdoor positions.

BRIEF DESCRIPTIONS OF THE INDIVIDUAL FIGURES OF THE DRAWINGS

DETAILED DESCRIPTION OF THE DRAWINGS

Attention is directed first to the overall nature of the accompanying drawings. The drawings fully illustrate the positional relationship between the movable units containing the arenas or playing fields and the fixed domed structure, as well as the surrounding area of the structure, but they are shown semi-diagrammatically, at least in part, because the overall physical or mechanical construction is made according to standard and known details. The main features of the invention reside in the relative positional arrangement, and the interrelation of the functions of the various parts, and of the entire stadium structure.

The following description treats first of the fixed structure and then of the mobile units, but briefly each mobile unit contains an arena or playing field, and by putting the unit in position, the playing field on it is put in active position.

Figure 1:
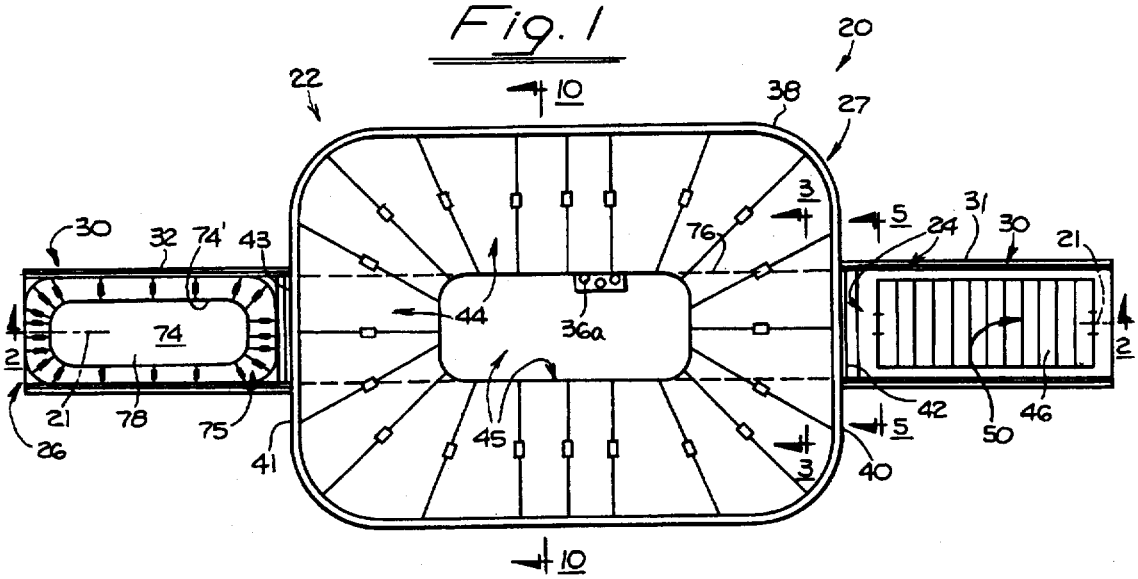
FIG. 1 is a semi-diagrammatic plan view of the domed stadium structure of the invention, oriented according to line 1—1 of FIG. 2 showing both of the movable units withdrawn from the stadium and positioned in the exterior; in this figure the domes are not shown.
Figure 2:
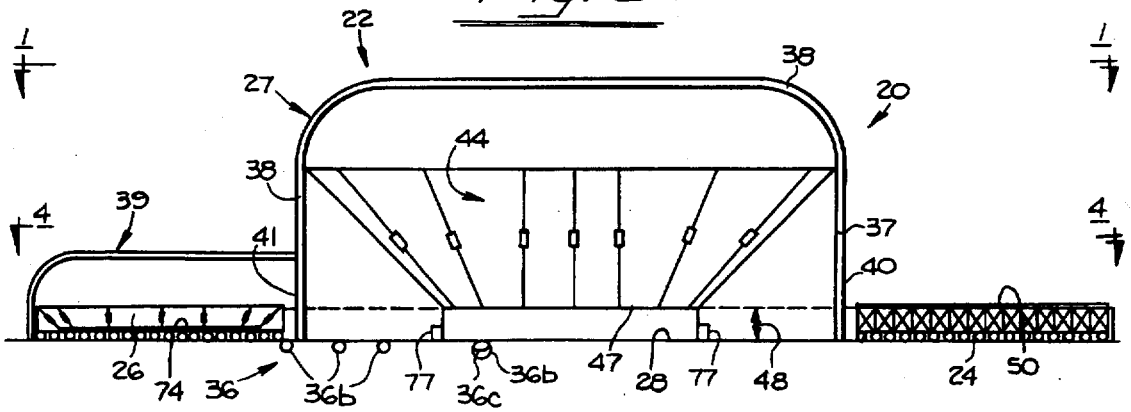
FIG. 2 is a longitudinal vertical sectional view oriented according to line 2—2 of FIG. 1, and showing the domes.

FIGS. 1–2 show the entire game field or stadium 20, which includes as main components, (a) a fixed stadium structure itself 22, and (b) two movable units 24, 26, referred to as first and second movable units respectively. The outline shape of the structure may be as desired. In the present case the example of game accommodated is football, and accordingly, the structure is elongated, having a central longitudinal axis 21. Other shapes may of course be utilized instead, if desired, for accommodating different kinds of games.

Figure 3:
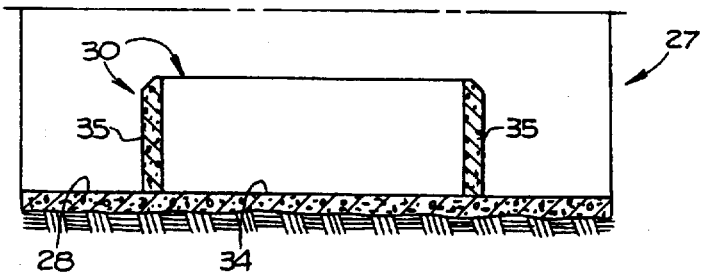
FIG. 3 is an end view taken at line 3—3 of FIG. 1 but showing only a portion of the construction.
Figure 4:
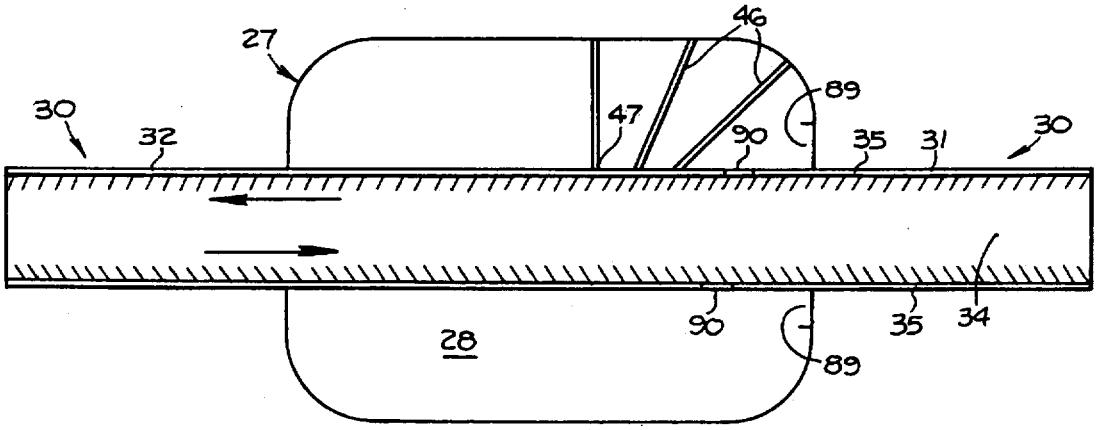
FIG. 4 is a horizontal view taken at line 4—4 of FIG. 2.

The fixed structure includes a main central portion, or amphitheater portion 27, forming a central enclosed building or main enclosure, which includes a floor 28 (FIG. 3), of hard surface material, extending throughout its area, and it has a section or portion 30 extending longitudinally and forming a course for accommodating the movable units in their movements, and thereby acting also as a track. The course 30 includes extensions 31, 32 projecting beyond the main portion 27. The course 30 also includes a floor 34 which may form a continuation of the floor 28, and guide side walls 35 also of rigid and strong material extending the full length of the course, through the structure. These walls are of uniform construction throughout their length, and serve as side guides for the movable units as the latter are moved, as referred to again hereinbelow.

The floor 34 and, to an extent, the floor 28 are exposed to rain and they are provided with a drainage system 36 (FIGS. 1, 2) for draining the entire area of the floor, this system including for example perforated top plates **36*a* (FIG. 1) and conduits or tubes 36*b* (FIG. 2). It may be desired to heat the space in the main unit 27, and means for this purpose may be provided in any of various ways, but the invention is of such broad scope as to cover heating by means of heating elements 36*c* in the conduits 36*b***. Similar drainage and heating in the movable units may also be provided as referred to below.

Figure 5:
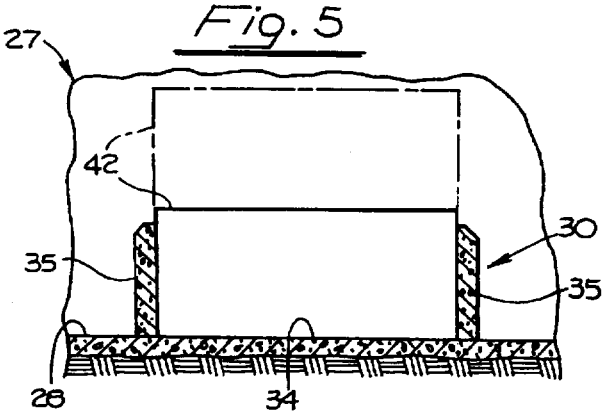
FIG. 5 is a view taken at line 5—5 of FIG. 1.

The main central portion 27 includes a surrounding wall 37 and a dome or roof 38, and similarly a dome 39 is provided at one end, in this case (FIG. 2) over the outer extension 32 of the course 30. The surrounding wall and dome are shown somewhat diagrammatically, since the detail construction is not of the essence of the device. Thus certain of the views are simplified by omitting such details, such as the dome or roof (FIGS. 1, 4, 6, 8). The structure has ends 40, 41 in which are formed doors 42, 43 (FIG. 5) for movement of the movable units therethrough. The doors may be slidable or swingable, for example, as desired.

The main central portion 27 includes a fixed seating structure or arrangement 44 forming an amphitheater, surrounding a central elongated void or opening 45 (FIGS. 1, 2). The seating structure 44, in itself may be of any desired structural design which includes trusses or elements 46 (FIG. 4), of desired design and structure and supported in a suitable manner. The inner lower extremity 47 (FIG. 2) of the amphitheater seats are disposed at an elevated position above the floor 28, as indicated by the double-headed arrow 48. This positioning will be referred to again in relation to the movable units.

Figure 10:
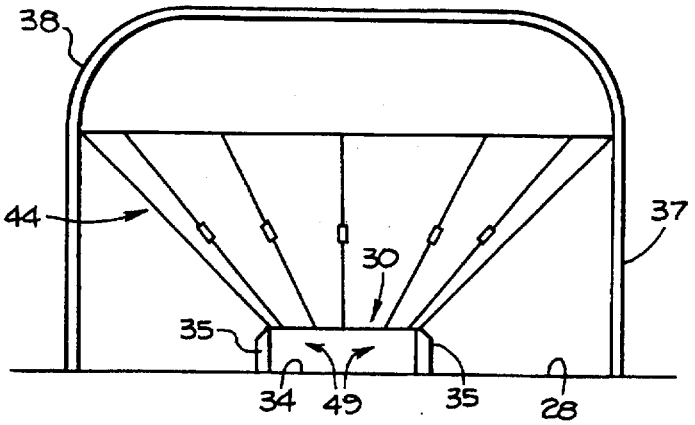
FIG. 10 is a vertical transverse sectional view taken at line 10—10 of FIG. 1.

Since the course 30 is open and unobstructed to accommodate the movable units, the seating 44, at the ends of the main central portion 27 (FIGS. 7, 10), is provided with necessary structure of sufficient strength, according to known design, to provide the necessary supporting strength for the seating extending across the full width of the course 30 as indicated at 49.

Figure 6:
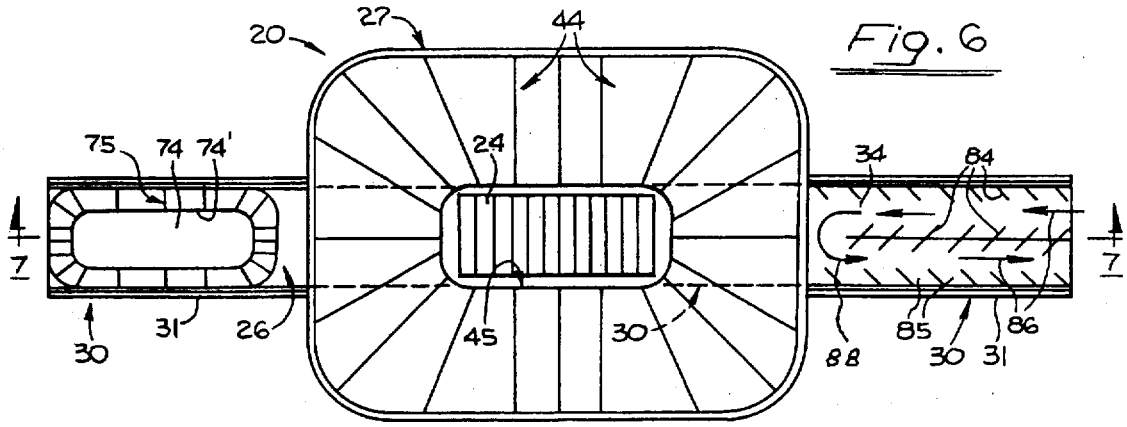
FIG. 6 is a plan view of the stadium, and thus oriented according to FIG. 1, but showing one of the movable units in the stadium, and another one at the exterior.
Figure 7:
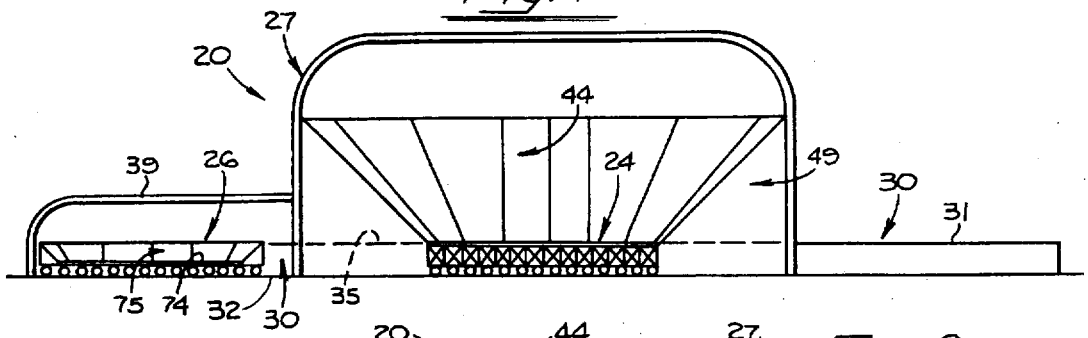
FIG. 7 is a longitudinal vertical sectional view taken at line 7—7 of FIG. 6.
Figure 8:
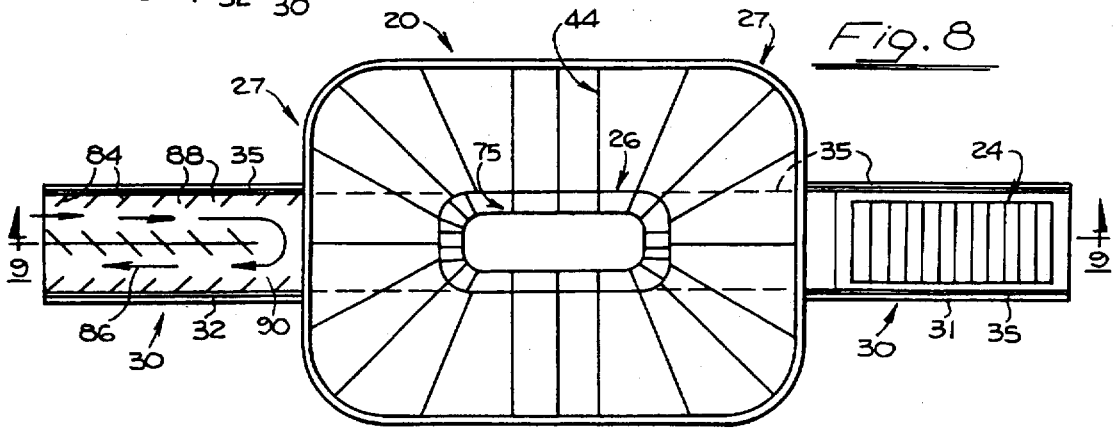
FIG. 8 is a view similar to FIG. 6 but showing the playing fields in positions respectively opposite those in FIG. 6.
Figure 9:
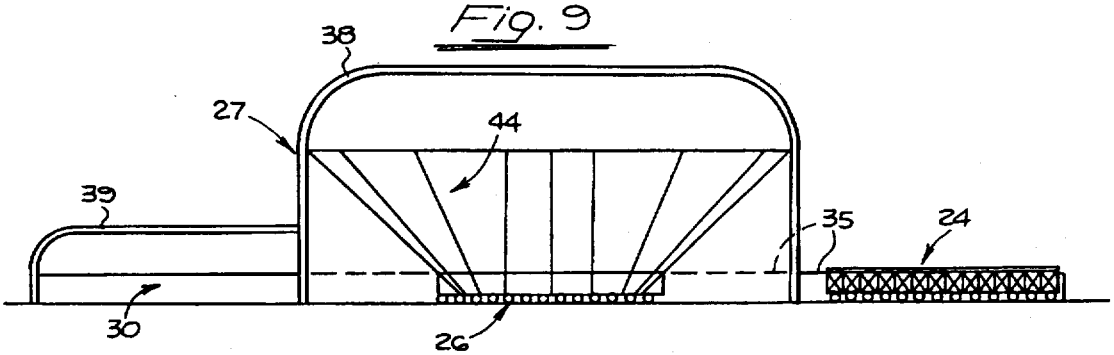
FIG. 9 is a longitudinal vertical sectional view taken on line 9—9 of FIG. 8.

To direct full attention to the various parts of the stationary structure, in relation to the movable units, it is pointed out that the two movable units (24, 26) are so constructed and arranged that when either is in active position, it is located under, or effectively in, the central void 45 in the main central unit 27. FIGS. 1 and 2 show both of the movable units withdrawn, and resting in the end sections of the course 30, on the exterior; FIGS. 6 and 7 show the unit 24 in position in the void 45, and the unit 26 withdrawn; FIGS. 8 and 9 show the units oppositely disposed, relative to FIGS. 6 and 7, i.e. the second unit 26 is in the void while the first unit 24 is withdrawn. These units are provided with wheels or rollers, in one form of construction, to enable their movement, as referred to below.

The first unit 24 is designed primarily for a football game, and is of a height greater than necessary for that game, but the second unit 26 is necessarily of a relatively great height because it includes the bleacher seats, and thus the first unit is made of the same height for correlation therebetween and consequent accommodation of the amphitheater seats 44 to both units.

Figure 12:
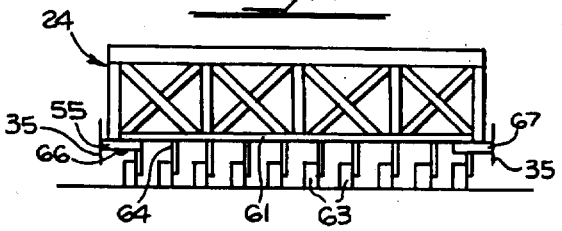
FIG. 12 is an end view of the movable unit of FIG. 11.

The guide side walls 35 are engaged by lateral guide wheels 55 (FIG. 12) on the movable unit 24, as described below. The various elements and parts are also relatively dimensioned vertically for accommodating these functions indicated. The guide side walls are effectively of the same height as the top of the movable units, and as referred to above (FIG. 4), the lower edge of the amphitheater seats 44 is closely adjacent the same level as the top surface of the movable units, although it need not be exactly so.

Concerning the movable units 24, 26, attention is directed to the first unit 24 (FIGS. 1 and 2) which has a relatively large arena or playing area 50, dimensioned for a football game, for example. The movable unit itself may be of any desired mechanical construction, and includes a top panel 58 (FIG. 11), having an upper surface 59 on which the playing area or arena 50 (FIGS. 1 and 2) is laid out, and a bottom panel 61. The height of this unit (FIG. 11) is indicated by the double-headed arrow 60 which is of course substantially equal to the vertical spacing indicated by the arrow 48 (FIG. 2). The unit includes various truss work 62 and wheels or rollers 63 supporting it. These wheels may be mounted on arms 64, or otherwise, in a known manner; they may be mounted in rigid structures, or yielding structures, for example, and they may have semi-resilient treads, operated hydraulically or pneumatically, etc. The specific form of these wheels and their mounting is not of the essence of the device.

The lateral guide wheels 55, mentioned above, are disposed on vertical axes 66 (FIG. 12), and extend laterally a suitable extent at 67, to engage the guide walls 35.

Figure 11:
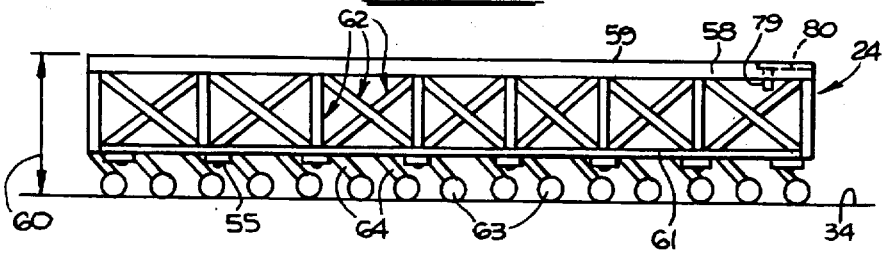
FIG. 11 is a side view of a movable unit.
Figure 13:
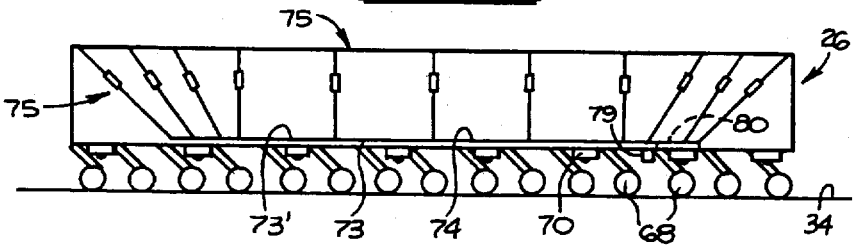
FIG. 13 is a side view of another movable unit.

Comparison is made with drainage and heating of the floors 28, 34 referred to above. It is also desired to provide drainage of the playing fields. Attention is directed to FIGS. 11, 13 showing tubes or conduits 79 leading from perforated drainage plates 80 in a manner similar to that referred to above in connection with FIGS. 1 and 2. These same conduits may be used for heating, in the manner described. Additionally, these conduits, or similar conduits may be used for irrigating the arena, particularly in the case of natural turf, this arrangement including an input conduit 81. Any or all of the arenas may be provided with these features of drainage, heating, irrigating.

Figure 14:
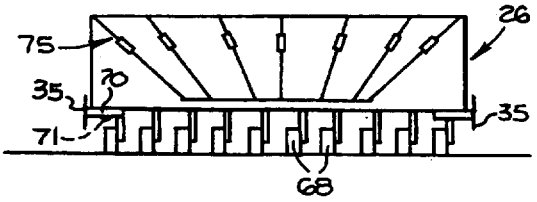
FIG. 14 is an end view of the movable unit of FIG. 13.

The second movable unit or playing field 26 is basically similar to the first unit 24, in construction, and as shown in FIGS. 13, 14, includes wheels or rollers 68 for rollingly supporting it, and is provided with lateral guide wheels 70 mounted on vertical axes 71, for engaging the guide side walls 35. The wheels 68 may be mounted similarly to the corresponding wheels 63 in FIGS. 11, 12.

As noted above, the second movable unit 26 has not only an arena or playing field or area, but a small seating construction, or bleacher seats. The unit 26 includes a panel 73 (FIG. 13) having an upper surface 73' on which the arena 74 (FIG. 1) is laid out. The outline dimensions of the complete movable unit, i.e., length and width, are similar to those of the first unit 24, but it contains bleacher seats 75, or second amphitheater unit, within the outline dimensions, around the periphery. These bleacher seats surround the arena 74, forming a void 74' exposing the arena, and thus this arena is smaller than the arena 50 on the first movable unit 24.

The bleacher seats 75 at their outer periphery are similar in dimensions to the void 45 for effectively being positioned or located therein and congruent therewith. The bleacher seats are also so inclined as to form a lower extension of the main amphitheater unit 44, or a continuation thereof. The specific truss structure of the bleacher seat units need not be described in detail, but may be similar to that of the main, large amphitheater unit.

The movable units may be secured against accidental movement longitudinally, when in active playing position, by any suitable means, such as retractable stops 77 (FIG. 2).

The unit 26 may be utilized to accommodate relatively small athletic events. The small playing arena or area 74 may accommodate for example basketball, etc. In the case of such a small athletic event, many times a smaller amphitheater will suffice, and thus the provision of this unit with its smaller bleacher unit 75.

The floor 34 (FIG. 3) of the course 30 is flat and substantially planar. This course provides parking for automobiles, and as shown in FIGS. 6 and 8 it is provided with parking stripes 84 to form stalls 85. This course is of substantial width, sufficient to provide two or more lanes of traffic, as indicated by the arrows 86, and the ends of the course are of course open. The parking stalls may appear throughout the full length of the course for parking at different locations therein. For example, when the first movable unit 24 is in active position (FIG. 6) the course is available for parking from its outer end, at the right, inwardly up to closely adjacent the end of the movable unit, which includes a certain area within the main central unit 27. In a similar manner, as in FIG. 8, when the second movable unit 26 is in the main enclosure 27, parking spaces are available from the left hand end of the course 30 into the main enclosure, up to a point closely adjacent that movable unit. The details of the parking arrangement may be as desired, but one example is to provide two or more lanes as indicated, and in each lane, are stalls 85, and in fact the course is sufficiently wide to enable automobile traffic to travel in loop paths, indicated at 88 (FIG. 6) to accommodate several lines of traffic, both incoming and outgoing.

Suitable openings 89 (FIG. 4) may be provided through the wall 37 to the spaces below the amphitheater seats 44, to enable parking in those spaces and similar openings 90 may be made in the guide side walls to enable flexibility in movement of automobiles in parking indoors. Each movable unit has a sufficient number of guide wheels (55,70) to span any such openings 90 to maintain full guiding effect.

Figure 15:
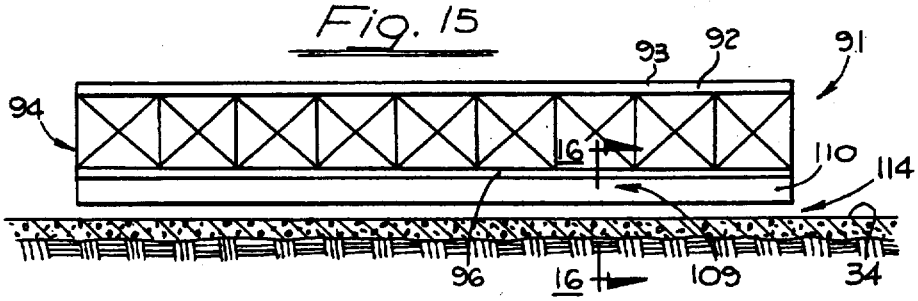
FIG. 15 is a longitudinal sectional view of a hover type movable unit.
Figure 16:
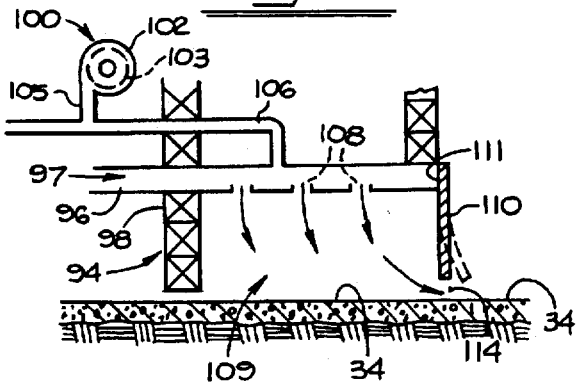
FIG. 16 is a sectional view taken at line 16—16 of FIG. 15.

FIGS. 15 and 16 show a different form of movable unit or playing field—a hover construction. In these figures a movable unit 91 is shown, which may be similar to either unit 24 or 26, in overall size and shape. The unit 91 has a top panel 92 on which the arena or playing area 93 appears. This panel is supported by a suitable truss structure 94.

The unit 91 has a bottom panel 96 which has an interior space 97 (FIG. 16) for containing compressed air for a hovering operation. The truss structure 94 may include posts 98 below the bottom panel, for solidly resting on the ground or the course 30 when it is at rest and not hovering. These posts may be in such number and at such locations, according to known structural engineering, to support the entire unit or playing field structure. The interior space 97 extends effectively throughout the full length and width of the unit, but from a practical and convenient standpoint, the bottom panel 96 may be made up of a plurality of sections independent from each other.

The movable unit or playing field 91 is provided with any of various kinds of means for producing the compressed air. As an example, compressor units 100 may be utilized, of sufficient size and in suitable number, to provide the necessary quantity of compressed air. In this case, each unit 100 includes a blower 102 driven by an electric motor 103. The blower has an outlet conduit 105 leading to a manifold 106 having outlets communicating with the various interior spaces 97. The bottom panel 96 has jets or holes 108 for passage of air therethrough to the space 109 below the panel.

The entire movable unit or playing field is provided with a skirt 110 secured to the bottom panel in a suitable manner, at 111, and extending therebelow.

Upon operating the hovering or suspending function, the air passing through the jets 108 into the space 109 below the bottom panel is compressed to a degree, and reacting against the surface of the course 30, lifts the entire unit or playing field. When the air is blown into the space 109, it of course builds up pressure but the skirt 110 confines that air to a great extent, but not entirely, the skirt being lifted off of the ground surface as indicated at 113, and the entire movable unit being lifted only to the extent of the confinement of the air in that space. The skirt may be semi-rigid, flexing to an extent, and permitting the escape of air in amounts only necessary to maintain the movable unit or playing field in lifted or elevated position. The entire unit structure is supported entirely by the cushion of air below it, providing great ease in moving it.

Appreciation of the size and massiveness of the entire structures may be gained by realizing that each movable unit is on the order of 400' by 200' in outline dimensions.

Figure 17:
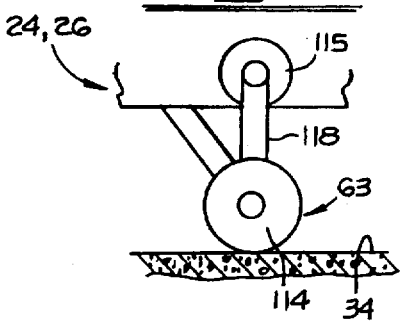
FIG. 17 is a diagrammatic view of an electrical power unit, including a wheel, for moving the playing field.

The movable units of any of the kinds of 24, 26, 92 may be moved by any desired kind of power. In the case of the units 24, 26, the means shown in FIG. 17 may be used, which includes a powered wheel 114. As many of these powered wheels as are necessary are utilized, these wheels being among the wheels 63 and thus also being supporting wheels. For driving these wheels, any desired kind of power means may be utilized, such as electrical, mechanical, hydraulic, pneumatic. In the present case an electrical arrangement is utilized, where each such powered wheel 114 is driven by an electric motor 115 through a belt 118. Upon operation of all the powered wheels, the movable unit is thereby moved.

Figure 18:
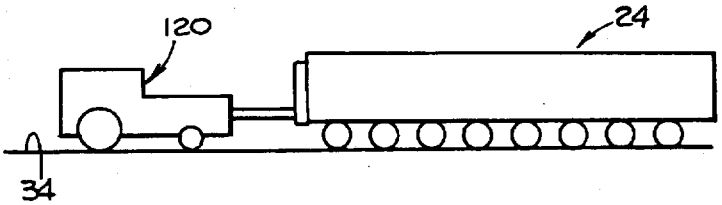
FIG. 18 shows moving the movable unit by a pusher.
Figure 19:
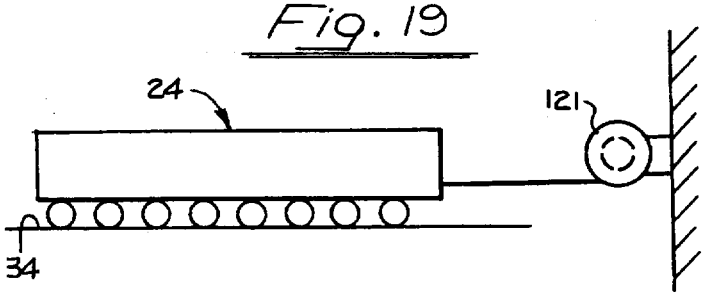
FIG. 19 shows moving the movable unit by a winch.

Other power means may be used for moving any of the movable units, such as in FIG. 18 which shows a tractor/pusher 120 by which the movable unit is moved, or a winch such as indicated at 121 in FIG. 19. A second winch can be used for pulling the movable unit in the opposite direction.

The floor 34 of the course 30 is preferably extremely smooth, so as to require a very minimum of moving force. This would be true in connection with either of the playing fields 24, 26, or the playing field 91. In the case of the latter, especially, an extremely smooth surface would be desired, but that requirement would not be as great as in the case of the other playing fields.

I claim:

1. A game field comprising, a fixed domed structure forming and including a central enclosed building having a surrounding wall and a covering dome defining an interior space, the building having a continuous main floor throughout its extent, the building also having a continuous course extending therethrough with opposite end portions extending beyond the building to the exterior, the course having an upper surface continuous with and forming extensions of the main floor, a fixed amphitheater in the building having a lower edge spaced from an opposed wall and spaced above the floor, defining a void, a self-contained, fixed construction, completely unitary, mobile unit supported on said course and movable thereon into and out of said void and also into the building, and out of the building onto the corresponding end portion of the course, the mobile unit having a flat top surface forming a playing field with an arena and bleacher seats surrounding the arena, and the mobile unit when out of the building being capable of accommodating a sports game and spectators, and when in the void in the building, the bleacher seats forming a continuation of the amphitheater.

2. A game field according to claim 1 wherein, the amphitheater extends continuously around the interior space and the lower edge surrounds and defines said void, and the amphitheater thereby surrounds the arena.

3. A game field according to claim 1 wherein, the course includes side guide walls extending throughout the length of the course operable for engagement by the mobile unit in the movements of the latter and thereby guiding the mobile unit in its movements.

4. A game field according to claim 1 wherein, the entire main floor and the upper surface of the course constitute a hard surface.

5. A game field according to claim 3 wherein, the mobile unit includes guide side wheels rotatable on vertical axes engageable with the side guide walls for guiding the mobile unit along the course.

6. A game field according to claim 1 wherein, the mobile unit includes a top panel defining the perimeter of the mobile unit, and bearing said top surface, and said arena extends substantially throughout the area of said top surface.

7. A game field according to claim 1 wherein, the mobile unit includes a top panel defining the perimeter of the mobile unit, and bearing said top surface, the arena is smaller than the top surface, and the mobile unit includes bleacher seats thereon surrounding the arena.

8. A game field comprising, a fixed domed structure having a surrounding wall, a floor, and a covering dome defining an interior space, an amphitheater in the building having a lower edge spaced from an opposed wall and spaced above the floor, defining a void, and a first and a second mobile unit at opposite ends of the void and movable alternately into and out of said void, each mobile unit having a top panel bearing an area which, when the respective mobile unit is in the void, is positioned adjacent the lower edge of the amphitheater.

9. A game field according to claim 8 wherein, in the first mobile unit the arena extends substantially throughout the area of the top panel.

10. A game field according to claim 8 wherein, in the second mobile unit, the arena is relatively small, and the second mobile unit includes bleacher seats surrounding the arena.

11. A game field according to claim 10 wherein, the mobile units are of substantially the same outline dimensions, and their relative heights are such that the top of each mobile unit is effectively of the same height as the top of the bleacher seats on the second mobile unit, whereby, the amphitheater extends respectively substantially from the edges of the arena on the first mobile unit, and from the top of the bleacher seats on the second mobile unit and effectively forms a continuation from the bleacher seats.

12. A game field according to claim 1 wherein, said course constitutes a parking lot in the positions in which no mobile units are positioned.

13. A game field according to claim 12 wherein, said course is continuous and uniform throughout its length, and is provided with markings forming traffic lanes and vehicle stalls.

14. A game field according to claim 4 wherein, said guide walls are of hard material and continuous with said main floor and the upper surface of the course.

* * * * *